United States Patent [19]

Hoffman et al.

[11] Patent Number: 4,978,935

[45] Date of Patent: Dec. 18, 1990

[54] ELECTROMAGNETIC RELAY

[76] Inventors: Jerzy Hoffman, 306 Bora Bora Way, Marina Del Rey, Calif. 90292; Krzysztof J. Ciezarek, 15335 Magnolia Blvd., #212, Sherman Oaks, Calif. 91403

[21] Appl. No.: 147,524

[22] Filed: Jan. 25, 1988

[51] Int. Cl.[5] ..... H01H 67/02

[52] U.S. Cl. ..... 335/121; 335/84

[58] Field of Search ..... 335/78–86, 335/88, 95, 47, 279, 124, 121

[56] References Cited

U.S. PATENT DOCUMENTS

| | | | |
|---|---|---|---|
| 2,915,681 | 12/1959 | Troy | 335/229 |
| 3,142,784 | 7/1964 | Bloomfield | 335/84 |
| 3,218,523 | 11/1965 | Benson . | |
| 3,484,729 | 12/1969 | Adams et al. | 375/230 |
| 3,504,315 | 3/1970 | Stanwell . | |
| 4,122,420 | 10/1978 | Brown . | |
| 4,150,348 | 4/1979 | Foltz . | |
| 4,259,653 | 3/1981 | McGonigal . | |
| 4,316,167 | 2/1982 | Koehler . | |
| 4,533,890 | 8/1985 | Patel . | |
| 4,782,315 | 11/1988 | Bataille . | |

FOREIGN PATENT DOCUMENTS

| | | |
|---|---|---|
| 0272164 | 10/1987 | European Pat. Off. . |
| 657481 | 7/1947 | United Kingdom . |
| 958501 | 6/1960 | United Kingdom . |

*Primary Examiner*—E. A. Goldberg
*Assistant Examiner*—Lincoln Donovan
*Attorney, Agent, or Firm*—Spensley Horn Jubas & Lubitz

[57] ABSTRACT

A high-speed, high-reliability electromagnetic relay particularly adapted for use in electronic systems with signal frequencies from DC in excess of 20 MHz. A ferro-magnetic armature is attached to an actuator plate made of dielectric material which is in contact with a flexible contact reed. One end of the contact reed is in fixed electrical contact with an input pin and the other end is movable between a normal position in electrical contact with a first output pin and a second position in electric contact with a second output pin. To improve resistance to environmental extremes such as shock and vibration, a permanent magnet can be located so that its attractive force holds the armature in the normal position. An electromagnet is located such that when it is activated the attractive force of the permanent magnet is overcome by the attractive force of the electromagnet, moving the armature to the second position and causing the actuator plate to move the contact reed into electrical contact with the second output pin.

11 Claims, 6 Drawing Sheets

ELECTROMAGNETIC RELAY

BACKGROUND OF THE INVENTION

1. Field of the Invention

This invention relates to electromagnetic relays.

2. Description of Related Art

Although there have been many recent advances in the technology related to all-electronic switching devices, electromagnetic relays are still required in many applications for which all electronic devices are not suitable. As a result, there is a need for reliable electromagnetic relays, particularly in applications where the device is subject to vibration, high impact, high acceleration, and fluctuating thermal and humidity conditions.

In the past, electromagnetic relays which were capable of withstanding these adverse conditions, have often been internally complex. As a result, many such prior art devices are expensive and difficult to manufacture. For example, a typical prior art relay is a model 412K Series TO-5 Relay manufactured by the Teledyne Corporation. This relay includes a clipper type armature having two small push pins with an insulating glass bead to push a contact reed from a first position to a second position when the electromagnetic force attracts the armature, and a return spring to push the armature to its first position when the electromagnet is deactivated. The construction of the armature as well as the complex arrangement of its contact members makes this relay extremely difficult to manufacture. This design also has a relatively high number of moving parts and welded joints which are subject to failure. As a result, the reliability of this relay limits its usefulness in many applications.

Another previous design replaces the spring and armature system with a bar-shaped slider which is mechanically coupled to the contact reed. The slider is provided with a permanent magnet which is normally attracted to the electromagnet; thus, holding the slider and the contact reed in a first position. Activation of the electromagnet repels the permanent magnet moving the slider and the reed to a second position. However, because of present technological limitations, this design is not suitable for miniaturization to a standard TO-5 case relay.

SUMMARY OF THE INVENTION

It is an object of the present invention to provide an improved relay obviating for practical purposes, the above mentioned limitations, particularly in a manner requiring a relatively uncomplicated mechanical arrangement.

It is a further object to provide an electromagnetic relay that is highly reliable, simple in construction, relatively inexpensive to manufacture, and is able to withstand the environmental conditions typical in applications requiring such relays.

A relay in accordance with a preferred embodiment of the present invention includes an armature made of a ferro-magnetic material, positioned below an electromagnet. To increase resistance to shock and vibration, a permanent magnet can be located such that the armature is held in a first position by the attractive force of the permanent magnet. When the electromagnet is activated, the attractive force of the electromagnet overcomes that of the permanent magnet, moving the armature to a second position. The armature is mechanically or magnetically coupled to at least one contact reed, one end of which is in electrical contact with an input pin. The other end is movable between two output pins, so that when the armature moves from the first position to the second position the movable end of the contact reed moves from a first position in electrical contact with the first output pin to a second position in electrical contact with the second output pin.

Further advantages and structure will be better understood in view of the detailed description below and the accompanying drawings.

DETAILED DESCRIPTION OF THE DRAWINGS

Figure 1:
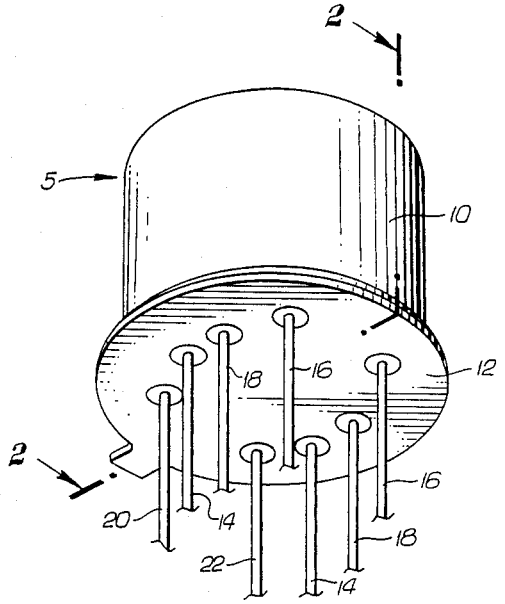
FIG. 1 is a perspective view of a double-pole, double-throw relay in accordance with one embodiment of the present invention.
Figure 2:
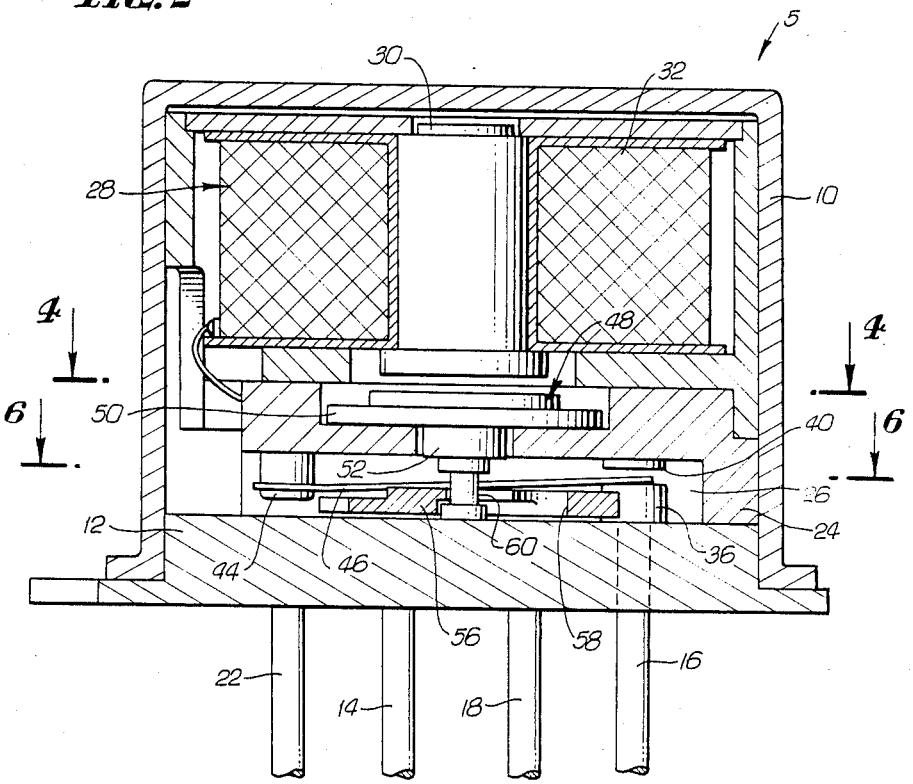
FIG. 2 is a cross-sectional view of the relay shown in FIG. 1, taken along line 2 in FIG. 1.
Figure 3:
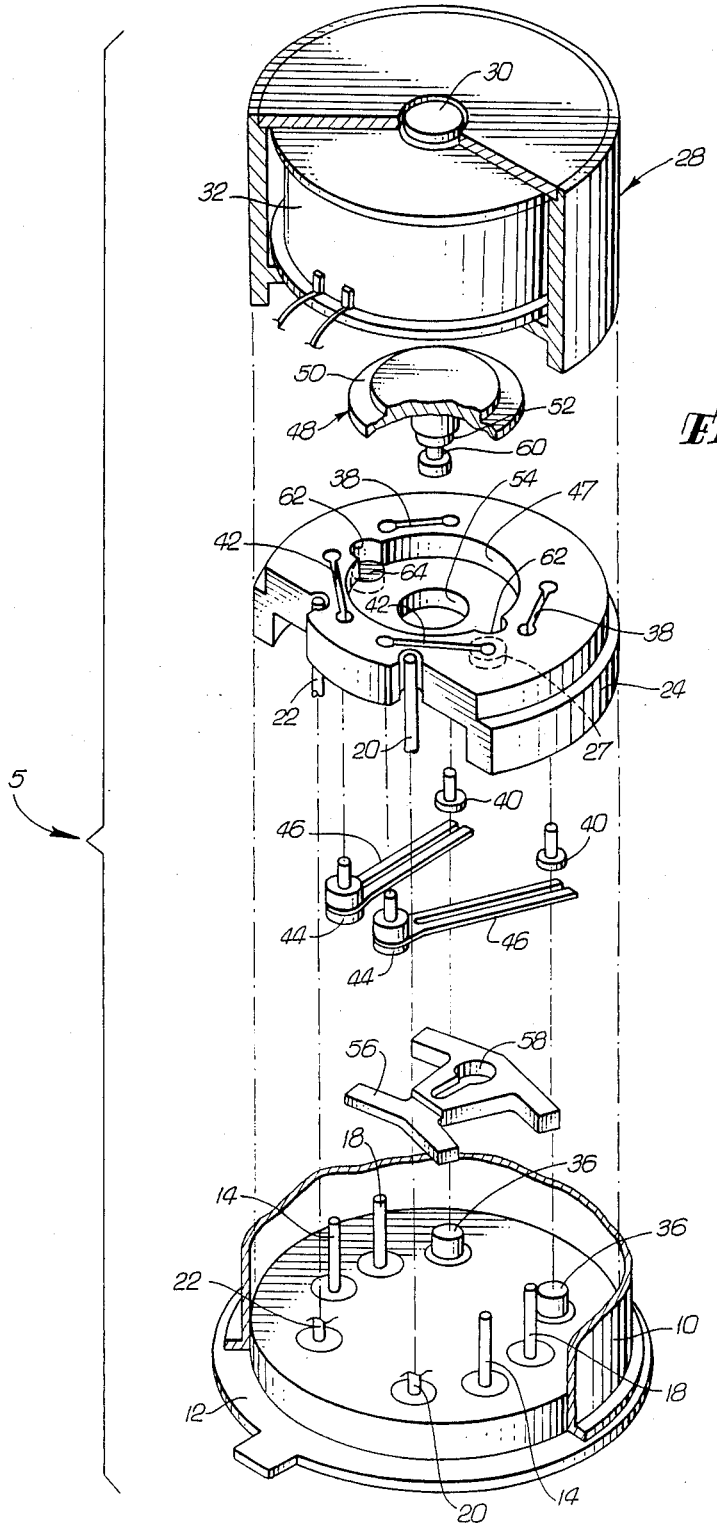
FIG. 3 is an exploded view of the relay shown in FIG. 1.

FIGS. 1–3 show a double-pole, double-throw relay 5 in accordance with one embodiment of the present invention. The relay 5 is symmetric about line 2–2 of FIG. 1 such that the following description will be primarily limited to one half of the relay.

The relay 5 includes an outer case 10 (shown partially cut away in FIG. 3) which is preferably made of a material such as brass, aluminum, KOVAR or a similar material. Although the case 10 is shown having a cylindrical shape, it is recognized that the case 10 could have other shapes such as cubical or spherical. The case 10 of the illustrated embodiment is shaped so as to conform with that of a particular industry standard, that is, the T0-5.

Connected at the lower end of the case 10 is a base 12 which is also preferably made of a material such as KOVAR or a similar material. The base 12 is pierced by a conductive input pin 14, a first conductive output pin 16, a second conductive output pin 18, and coil pins 20 and 22. The pins are encased in a dielectric or insulative material at the point of passage through the base 12.

Situated within the outer case 10 and resting on the base 12 is a guide plate 24 that serves several functions. The guide plate 24 is preferably made of an insulative material on which surface contacts can be plated and is shaped so as to form a cavity 26 between the guide plate 24 and the base 12. The guide plate 24 is provided with holes 27 through which the input pin 14 and the second output pin 18 pass. The guide plate is further configured to allow coil pins 20 and 22 to pass around it.

As best seen in FIG. 2, situated within the outer case 10 above the guide plate 24, is an electromagnet 28 comprising a core 30 and a yoke 32. The coil pins 20 and 22 provide power to the electromagnet 28 for activating the relay.

Figure 4:
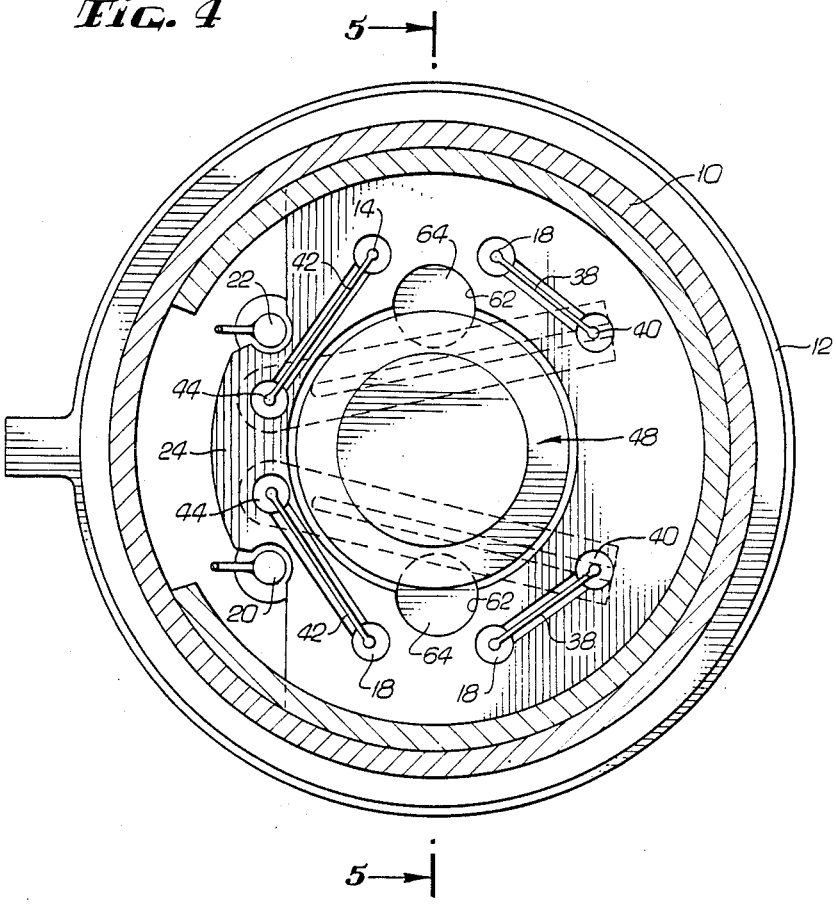
FIG. 4 is a cross-sectional view of the relay, taken along line 4 in FIG. 2.

The first output pin 16 passes through the base 12 and terminates at a first output contact terminal 36. The second output pin 18 passes through the base 12, extends through the guide plate 24 and terminates near the upper surface thereof. As best seen in FIGS. 3 and 4, the upper surface of the guide plate is provided with a first conductive strip 38 so that the second output pin 18 is in electrical contact with a second output contact terminal 40. In a similar fashion, the input pin 14 passes through the base 12, extends through the guide plate 24 and terminates at the upper surface thereof. A second conductive strip 42 is provided on the upper surface of the guide plate electrically connecting the input pin 14 to an input contact terminal 44.

Figure 5:
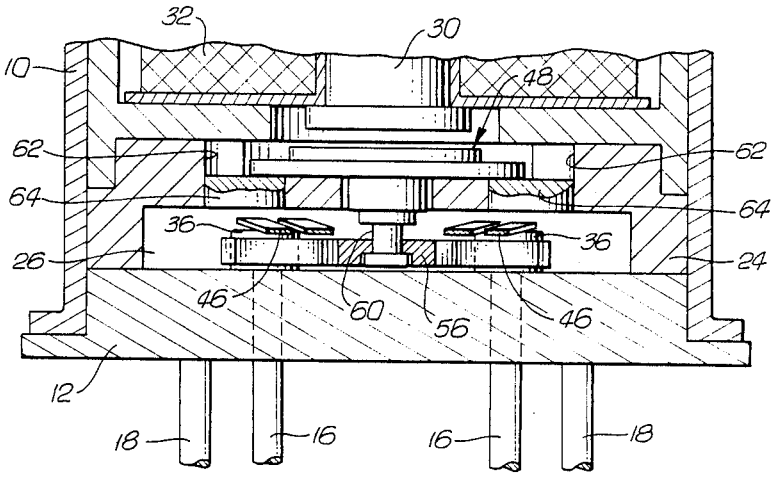
FIG. 5 is a partially cut-away cross-sectional view, taken along line 5 in FIG. 4.
Figure 6:
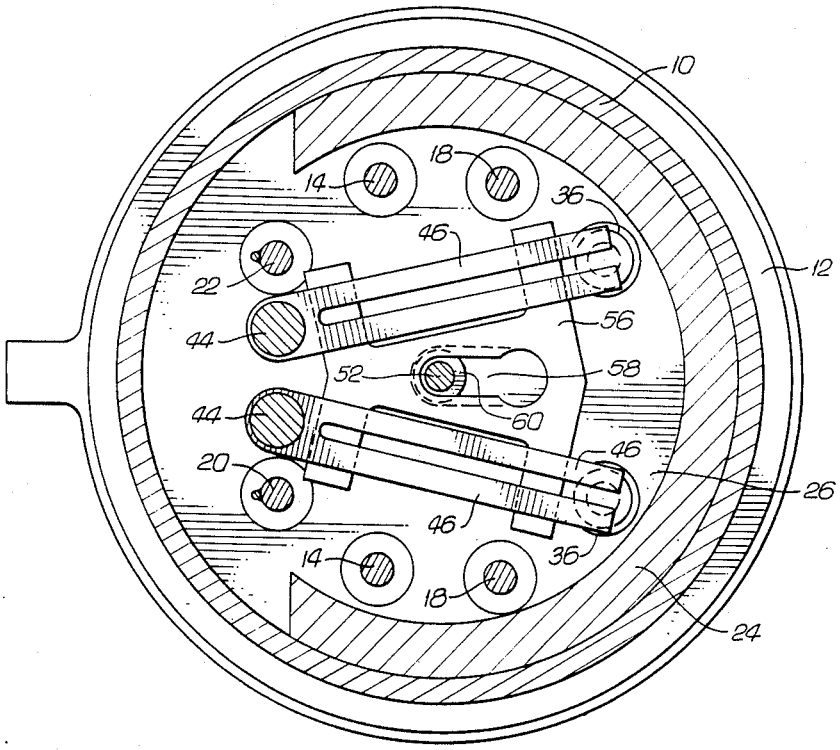
FIG. 6 is a cross-sectional view of the relay, taken along line 6 in FIG. 2.

The input contact terminal 44 extends slightly into the cavity 26 and has one end of a flexible contact reed 46 rigidly attached to it. The contact reed 46 extends from the input terminal 44 so that its free end is movable between the first output contact terminal 36 and the second output contact terminal 40. As seen in FIG. 6, the free end of the contact reed 46 is bifurcated, allowing better electrical contact between the contact reed 46 and the output contact terminals 36 and 40. As best seen in FIGS. 2, 5 and 6, the movable end of the contact reed 46 is normally held in contact with the first output contact terminal 36 by the spring force of the contact reed 46.

The upper side of the guide plate 24 defines a cylindrical cavity 47 shaped to receive an armature 48 made of a ferro-magnetic material. In the embodiment shown in FIG. 3, the armature 48 is configured in the shape of a disc portion 50 with a cylindrical connecting rod portion 52 extending downward from its center. A hole 54 is provided in the cavity 47 of the guide plate 24 through which the connecting rod portion 52 extends into the cavity 26. The hole 54 is sized such that the connecting rod portion 50 can slide freely therein.

Within the cavity 26 is an actuator plate 56 made of a dielectric material such as plastic. The actuator plate is best illustrated in FIGS. 3 and 6. Preferably, the actuator plate 56 is shaped so as to contact the contact reed 46 near the ends thereof. In this manner, an efficient means of moving the contact reed 46 without binding is provided. The center of actuator plate 56 includes a slot 58 with one end thereof enlarged so as to allow the connecting rod portion 52 of the armature 48 to pass through. The connecting rod portion 52 of the armature 48 has an annular groove 60 near its end such that the inside diameter of the groove corresponds to the width of the slot 58 in the actuator plate 56. Thus, the actuator plate 56 can be connected to the armature 48 by passing the connecting rod portion 52 through the enlarged end of the slot 58 and sliding the actuator plate 56 so that the narrow portion of the slot is received by the annular groove 60 as shown in FIGS. 5 and 6. This method of connecting the actuator plate 56 to the armature 48 allows some play between the two elements and still causes the actuator plate 56 to move whenever the armature 48 moves.

Referring to FIGS. 3–5, the guide plate 24 is further provided with a recess 62 wherein a permanent magnet 64 is located. The permanent magnet 64 is held in place within the recess by epoxy or some similar means.

Figure 7:
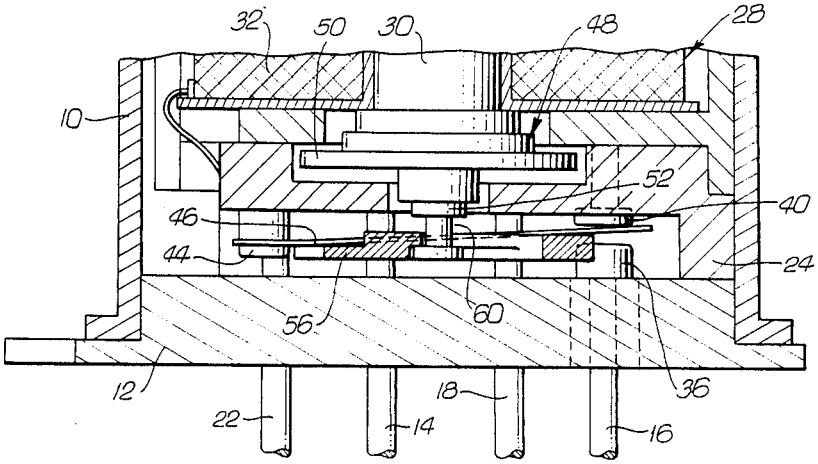
FIG. 7 is a cross-sectional view of the lower portion of the relay shown in FIG. 2, taken along line 2 in FIG. 1, showing the relay in its activated position.

As shown in FIG. 5, the attractive force of the permanent magnet 64 holds the disc portion 50 of the armature 48 against the upper surface of the guide plate 24. Consequently, when the relay is subjected to shock or acceleration the armature and actuator plate remain stationary and do not interfere with the contact reeds. However, when electric current is applied to the electromagnet 28, the attractive force of the electromagnet 28 overcomes the attractive force of the permanent magnet 64 and the armature 48 is moved toward the electromagnet 28. As a result, the actuator plate 56 moves, pulling the movable end of the contact reed 46 away from the first output contact terminal 36 and into electrical contact with the second output contact terminal 40, as shown in FIG. 7. The force of the electromagnet positively holds the contact reed against the second output contact so that electrical contact is maintained, even when the relay is subject to shock or acceleration.

Normal wear of the contacts will not cause any loss or interruption of the signal since the spring force of the contact reed will constantly force the contact reed into contact with the first output contact terminal and the magnetic force of the electric magnet will positively force the contact reed into contact with the second output contact terminal.

Figure 8:
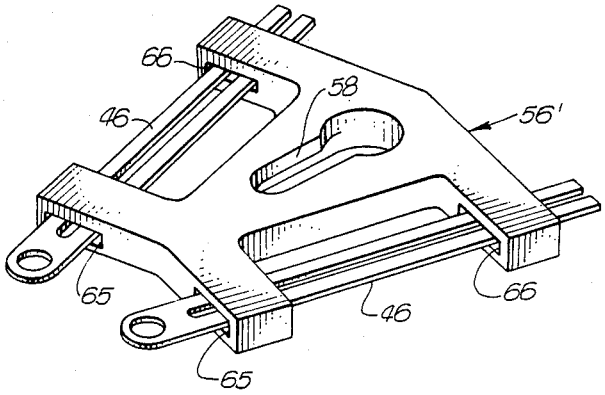
FIG. 8 is an elevation view of the actuator plate and reed configuration of another possible embodiment of the present invention.

In a second embodiment shown in FIG. 8, an actuator plate 56′ is provided with slots 65 and 66 through which the contact reed 46 passes. This embodiment allows positive action switching in both directions by forcing the contact reed 46 into contact with the second output terminal 40 when the electromagnet 28 is activated and forcing the contact reed 46 into contact with the first output terminal 36 when the permanent magnet 64 pulls the armature 48 into its normal position.

Figure 9:
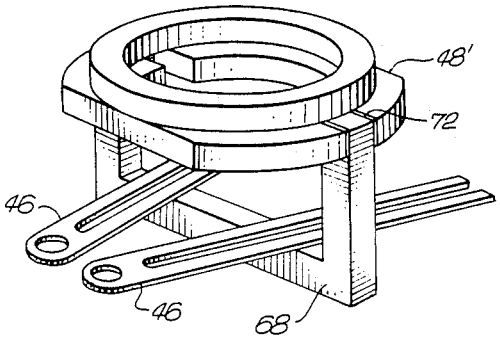
FIG. 9 is an elevation view of the armature and slider combination of another possible embodiment of the present invention.
Figure 10:
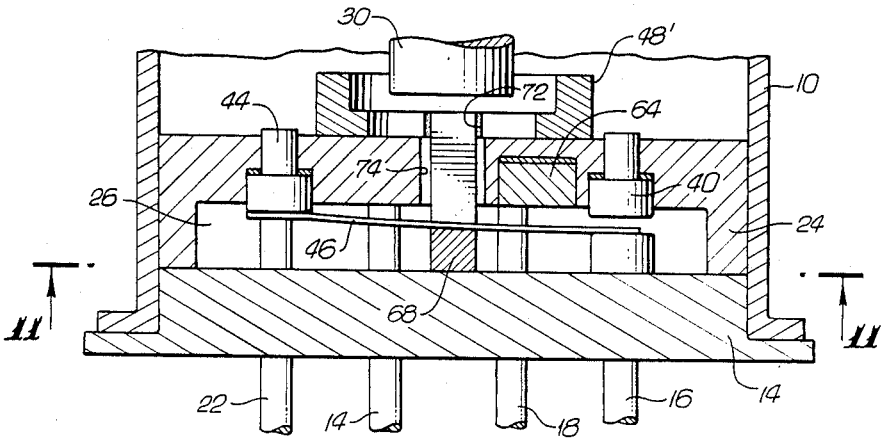
FIG. 10 is a cross sectional view of the lower portion of the relay with the armature and slider embodiment shown in FIG. 9, taken along line 10 in FIG. 11.
Figure 11:
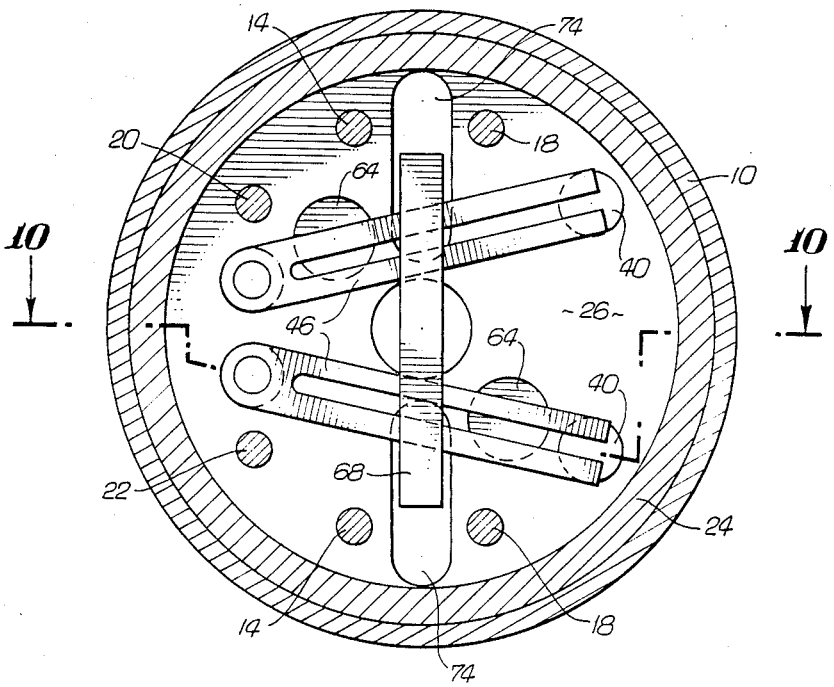
FIG. 11 is a cross-sectional view of the relay shown in FIG. 10, taken along line 11 in FIG. 10.

In another embodiment, illustrated in FIGS. 9–11, the actuator plate is replaced by a bar shaped slider 68 which contacts the contact reed 46 near its mid portion. The end of the slider 68 extends through a hole 74 provided in the guide plate, best seen in FIG. 11, and fits within slot 72 configured in an armature 48′. As shown in FIG. 9, the armature 48′ of this embodiment is a two-tiered ring shape, with the lower tier shaped so as not to interfere with the contact terminals and provided with slot 72. The slider 68 is attached to the armature 48′ with epoxy or a similar means. The slider 68 could also be provided with slots (not shown) through which the contact reed could pass to allow positive switching in both directions.

The inventive design thus has only three moving parts, the armature, the actuator plate and the pivoting contact reed. None of the moving components is soldered or spot welded. It is thus anticipated that the life of a relay made in accordance with the present invention will be longer than the typical life of many prior art designs.

The inventive design also provides for higher current capacity than many previous relays. This is because the basic geometry of the structure and the positive switching action allow the use of thicker contact reeds with higher current carrying capacity than the typical contact reeds used in prior art designs.

The simplicity of design of the present invention provides high reliability and resistance to environmental extremes of shock, acceleration, vibration, temperature, and humidity.

It will, of course, be understood that numerous modifications of the present invention, in its various aspects, will be apparent to those skilled in the art. For example, while a double-pole, double-throw relay is illustrated, the teachings of the present invention may be readily adapted to single-pole or multiple-pole relays, and to single-throw relays.

Further, a number of materials can be used for the various components of the inventive relay Although materials in the preferred embodiment ideally have high dielectric strength in the case of dielectric materials, and corrosion resistance and high conductivity in the case of conducting materials, a variety of similar materials may be substituted in accordance with standard engineering teachings. This list of possible variations is not to be taken in a limiting sense. Other modifications and variations are also possible, with their specific design being dependent upon a particular application. As such, the scope of the invention should not be limited by the particular embodiments described above, but is to be defined instead by the appended claims and equivalents thereof.

I claim:

1. An electromagnetic relay, comprising:

(a) an input terminal;

(b) a first output terminal;

(c) a second output terminal;

(d) a ferro-magnetic armature being movable between a first position and a second position;

(e) an electrically conductive contact reed coupled to the armature and being movable to contact the second output terminal, said reed being electrically coupled to the input terminal;

(f) at least one permanent magnet; and (g) an electromagnet, the armature being disposed between the permanent magnet and the electromagnet, the permanent magnet being positioned to attract the armature to the first position, and the electromagnet being positioned to attract the armature against the attraction of the permanent magnet to the second position to thereby move the contact reed to contact the second output terminal when activated.

2. An electromagnetic relay, comprising:

(a) an input terminal;

(b) a first output terminal;

(c) a second output terminal;

(d) a ferro-magnetic armature being linearly movable between a first position and a second position;

(e) an electrically conductive contact reed coupled to the armature, the contact reed having a first end in electrical contact with the input terminal and a second end being movable between the first and second output terminals;

(f) at least one permanent magnet separate from the armature and positioned to attract the armature to the first position; and (g) an electromagnet positioned to attract the armature against the attraction of the permanent magnet to the second position to thereby move the contact reed to contact the second output terminal when activated.

3. The relay of claim 1 or 2 wherein the contact reed comprises a leaf spring conductor such that the spring force of the reed moves the reed away from the second output terminal and towards the first output terminal when the electro-magnet is deactivated.

4. The relay of claims 1 or 2 further comprising an actuator plate made of insulative material, the actuator plate being mechanically or magnetically coupled to the armature and being positioned to engage the reed as the armature moves from its first position to its second position to thereby cause the reed to contact the second output terminal.

5. The relay of claim 4 wherein the actuator plate has a surface positioned to engage the contact reed as the armature moves from its second position to its first position to thereby cause the reed to contact the first output terminal.

6. The relay of claim 4 wherein the actuator plate is shaped so as to engage the reed near the ends thereof.

7. The relay of claim 4 wherein the armature comprises a disc shaped portion and a rod portion extending from the disc shaped portion, the rod portion being mechanically or magnetically coupled to the actuator plate.

8. An electromagnetic relay, comprising:

(a) an input terminal;

(b) a first output terminal;

(c) a second output terminal;

(d) a ferro-magnetic armature being linearly movable between a first position and a second position;

(e) a contact reed comprising a leaf spring conductor, one end of the contact reed in electrical contact with the input terminal, the other end being movable between the first and second output terminals but normally held in contact with the first output terminal by the spring force of the reed;

(f) an actuator plate made of insulative material mechanically or magnetically connected o the armature and engaging the contact reed near the movable end so as to move the reed from electrical contact with the first output terminal into electrical contact with the second output terminal when the armature moves from its first position to its second position;

(g) a permanent magnet separate from the armature and positioned to attract the armature to the first position; and (h) an electromagnet positioned to overcome the attraction of the permanent magnet and attract the armature to the second position, thereby moving the contact reed into contact with the second output terminal when activated.

9. The relay of claim 8 wherein the actuator plate has a surface positioned to engage the contact reed as the armature moves from its second position to its first position to thereby cause the reed to contact the first output terminal.

10. The relay of claim 8 wherein the armature is disposed between the permanent magnet and the electromagnet.

11. The relay of claim 10 wherein the armature comprises a disc shaped portion disposed between the permanent magnet and the electromagnet and a rod portion extending from the disc, the armature being moved between its first position and its second position by being linearly displaced in a direction parallel to the axis of the rod portion.

* * * * *